US010953557B2

(12) United States Patent
Davis

(10) Patent No.: US 10,953,557 B2
(45) Date of Patent: Mar. 23, 2021

(54) SAFETY UTILITY KNIVES AND METHODS

(71) Applicant: Raymond E Davis, Heath, TX (US)

(72) Inventor: Raymond E Davis, Heath, TX (US)

( * ) Notice: Subject to any disclaimer, the term of this patent is extended or adjusted under 35 U.S.C. 154(b) by 0 days.

(21) Appl. No.: 16/811,829

(22) Filed: Mar. 6, 2020

(65) Prior Publication Data

US 2020/0269449 A1 Aug. 27, 2020

Related U.S. Application Data

(62) Division of application No. 16/283,791, filed on Feb. 24, 2019, now Pat. No. 10,632,634.

(51) Int. Cl.

| | |
|---|---|
| ***B26B 11/00*** | (2006.01) |
| ***B26B 29/02*** | (2006.01) |
| *B26B 5/00* | (2006.01) |

(52) U.S. Cl.

CPC ..... *B26B 11/00* (2013.01); *B26B 29/02* (2013.01); *B26B 5/003* (2013.01)

(58) Field of Classification Search

CPC ..... B26B 11/00; B26B 29/02; B26B 29/025; B26B 3/08; B26B 5/001; B26B 5/003; B26B 5/005

See application file for complete search history.

(56) References Cited

U.S. PATENT DOCUMENTS

| | | | | |
|---|---|---|---|---|
| 2,376,887 | A * | 5/1945 | Waltern | B26B 29/02 30/125 |
| 2,644,230 | A * | 7/1953 | Anderson | B26B 27/005 30/151 |
| 10,086,521 | B2 * | 10/2018 | Huang | B26B 29/02 |
| 10,315,317 | B2 * | 6/2019 | Votolato | B26B 5/00 |
| 10,618,188 | B1 * | 4/2020 | Davis | B26B 29/06 |
| 10,632,634 | B1 * | 4/2020 | Davis | B26B 29/02 |
| 2010/0263219 | A1 * | 10/2010 | Kempker | B25F 1/02 30/337 |
| 2010/0293796 | A1 * | 11/2010 | Votolato | B26B 27/00 30/287 |
| 2015/0298330 | A1 * | 10/2015 | Yu Chen | B26B 27/005 30/280 |
| 2017/0120469 | A1 * | 5/2017 | Votolato | B26B 29/02 |
| 2018/0222073 | A1 * | 8/2018 | Votolato | B26B 5/00 |
| 2018/0333870 | A1 * | 11/2018 | Rus | B26B 5/006 |
| 2020/0269449 | A1 * | 8/2020 | Davis | B26B 29/02 |

* cited by examiner

*Primary Examiner* — Hwei-Siu C Payer
(74) *Attorney, Agent, or Firm* — Baker Law Firm

(57) ABSTRACT

A safety utility knife includes a pair of blades at one end of a handle. The cutting edges of both blades are configured to be shielded by a guard member. The guard member is movable with relation to the blade member.

2 Claims, 7 Drawing Sheets

SAFETY UTILITY KNIVES AND METHODS

CROSS-REFERENCE TO RELATED APPLICATIONS

This Non-Provisional is a Divisional Application of application Ser. No. 16/283,791 filed Feb. 24, 2019, now U.S. Pat. No. 10,632,634 and entitled "SAFETY UTILITY KNIVES AND METHODS."

TECHNICAL BACKGROUND

This disclosure relates to cutting rigid and semi-rigid materials.

BACKGROUND

Utility knives may be used to cut or slice a variety of materials, such as cardboard, corrugated board of varying thickness, rubber, lightweight plastic, or other packaging material. In order to cut or slice such material, the utility knife may need to have a sharpened blade. Certain precautions may be used to protect or help protect a user from the sharpened blade. For example, a utility knife may include guards that extend from the knife alongside the sharpened blade, such that the guards substantially prevent an accidental injury to the user or other bystander. Further, a utility knife may include a protective handle that encloses substantially all of a blade during periods of non-use. Utility knives, however, may be actuated accidentally even during periods of storage or non-use. Accidental actuation of a utility knife, therefore, may present a substantial hazard to the user, other persons, or valuable material.

SUMMARY

In a first example implementation, a safety utility knife includes: a handle that includes a gripping surface; a blade carriage positioned in a recess of the handle that partially extends from an opening of the handle through a cavity within the handle; a blade pair coupled to the blade carriage near a proximal end of the blade; the carriage is pivotably connected to the handle and configured to assume any of three positions—a neutral position configured to shield a cutting portion of each blade, a first active position that exposes the cutting portion of one of the blades, and a second active position that exposes the cutting position of the other blade of the pair. There is a cap coupled to each blade at a distal end of the blade.

In a first aspect combinable with the general implementation, the guide includes at least one pointed edge, the pointed edge configured to pierce the workpiece.

A second aspect combinable with any of the previous aspects further includes a portion of the guide that may continually contact an underside of a workpiece, when the knife is drawn through the workpiece.

In a third aspect combinable with any of the previous aspects, one or more carriage engagement members connect the carriage to portions of the handle.

In a fourth aspect combinable with any of the previous aspects, at least one of the carriage engagement members is configured to permit one of the three carriage positions.

In a fifth aspect combinable with any of the previous aspects, at least one of the one or more carriage engagement members includes a detent that may be a ball bearing, a spring, a prong, or other catch capable of engagement and disengagement.

In a sixth aspect combinable with any of the previous aspects, at least one of the one or more carriage engagement members is at least partially enclosed within the recess.

In a seventh aspect combinable with any of the previous aspects, each blade includes a cutting edge configured to engage the workpiece when one of the blades of the blade carriage is in an active position.

In a eighth aspect combinable with any of the previous aspects, the cutting portion contains a cutting edge which may be straight or curved.

In a ninth aspect combinable with any of the previous aspects, the blade carriage has a neutral middle position and left and a right active positions.

In a tenth aspect combinable with any of the previous aspects, a carriage shifter is configured to move the carriage into any one of three carriage positions and engage one or more of the detents in order to maintain the selected position.

In a twelfth aspect combinable with any of the previous aspects, the forward portion of the blade carriage includes sloped sides substantially parallel with a longitudinal side of the blades of the blade pair.

In a thirteenth aspect combinable with any of the previous aspects, the handle includes a tape splitter.

In a fourteenth aspect combinable with any of the previous aspects, the handle includes an auxiliary blade.

In another example implementation, a safety utility knife includes a handle with a gripping surface; a pair of blades are affixed to an end of the handle, each of the blades include a cutting edge and at least one face. A tapered guide member is formed at a distal end of each blade. A pivotable blade guard is mounted adjacent each of the blade faces. Each blade guard is configured to shield the blade and to pivot away from the cutting edge as the cutting edge is drawn through a workpiece, the workpiece bearing against the blade guard.

In a first aspect combinable with the example implementation, the guide member includes a piercing portion and a non-piercing portion.

In a second aspect combinable with the example implementation, each blade guard has a portion residing in a cavity or recess of the handle and an exposed portion.

In a third aspect combinable with any of the previous aspects, the blade may include a straight or curved cutting edge.

In another example implementation, a safety utility knife includes a single blade that is retractable into a recess of body of the utility knife at one end of the knife and a finger ring hold at an opposite end of the knife.

In a first aspect combinable with any of the previous aspects, the finger ring hold may also include a tape splitter portion.

In a second aspect combinable with any of the previous aspects, the finger ring hold may also include a secondary blade portion.

In a third aspect combinable with any of the previous aspects, the finger ring hold may also include a guide member, the guide member including a workpiece piercing portion.

In a fourth aspect combinable with any of the previous aspects, the utility knife may provide for extension of a cutting blade from a housing based on engagement with the blade (or a guide attached to the blade) with a work piece, rather than based on any actuation initiated by a user.

In a fifth aspect combinable with any of the previous aspects, the utility knife may provide for automatic retraction of the blade (or a cutting edge portion of the blade) into a housing for safety when the blade is not in use (e.g., engaging a workpiece).

In a sixth aspect combinable with any of the previous aspects, the utility knife may provide for replaceable blades.

In any of the foregoing implementations, a single blade or a blade pair may be replaced, or an entire carriage or shuttle including the blade pair may be replaceable. In such a case, the housing of the utility knife may include a removable portion (e.g., the handle may be a clamshell construction) to access the blade shuttle.

In any of the foregoing implementations, the guide may be non-detachable, being formed to a non-cutting portion of the blade(s) by means of molding onto the blade or sintering of one or more metallic powders.

In any of the foregoing implementations, no cutting edges are normally exposed prior to knife usage and then only the cutting edge a the active blade is exposed.

It should be understood that the features objects and aspects of the foregoing implementation may be combined with one or more of the various features objects and aspects of other implementations described herein.

These general and specific aspects may be implemented using a device, system or method, or any combinations of devices, systems, or methods. The details of one or more implementations are set forth in the accompanying drawings and the description. Other features, objects, and advantages will be apparent from the description and drawings, and from the claims.

REFERENCE LISTING OF THE NAMED ELEMENTS

Figure 1:
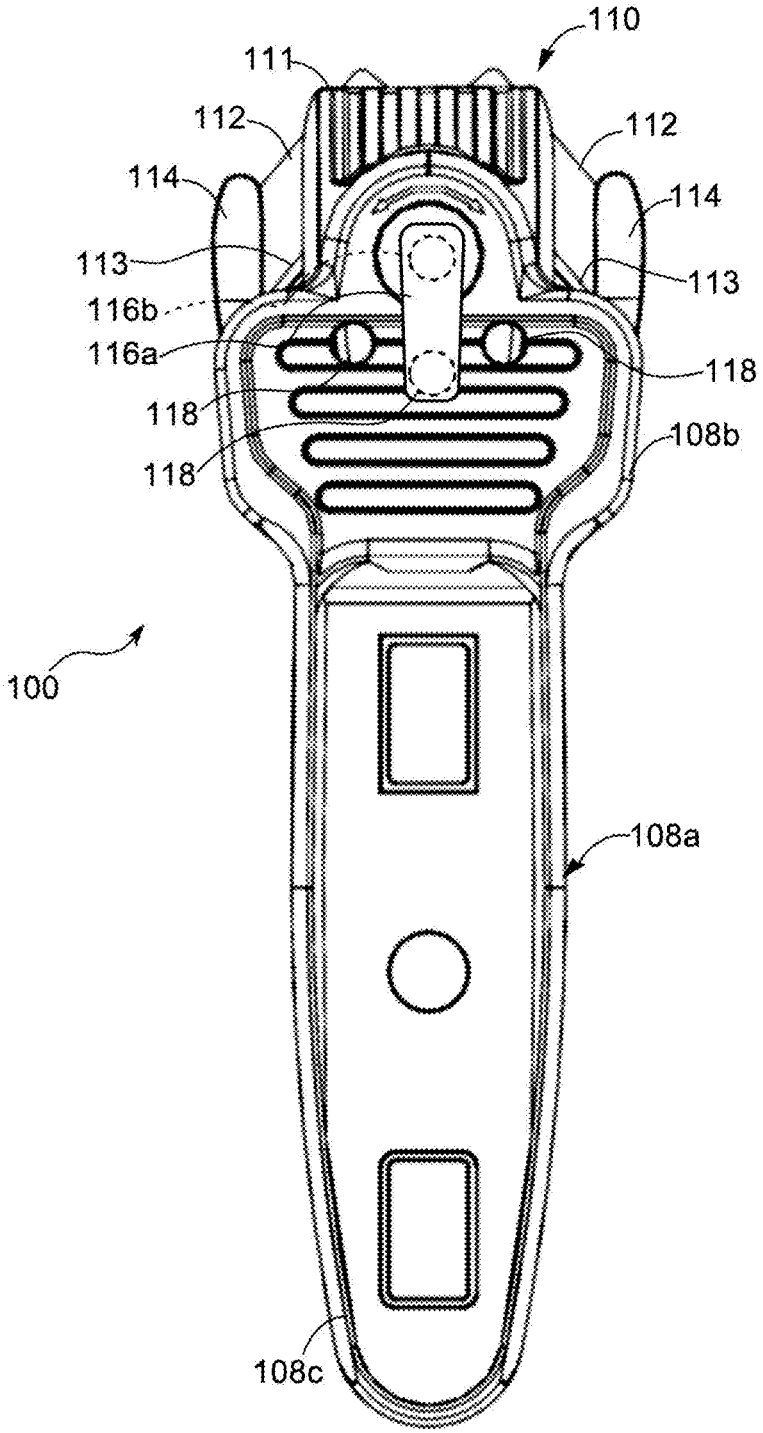
FIG. 1 is a side elevation showing an example implementation according to the present invention showing a blade carriage in a neutral position.
Figure 2:
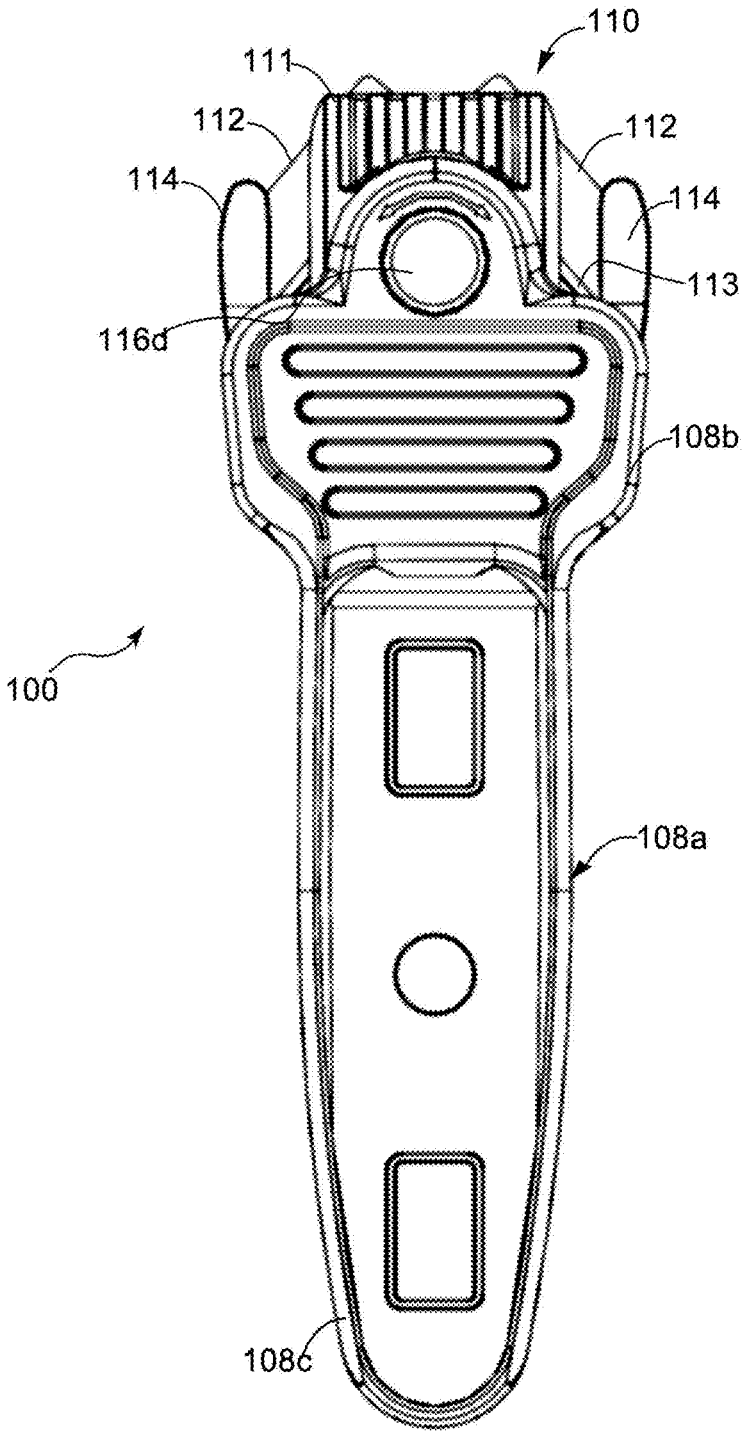
FIG. 2 is a side elevation opposite that shown in (FIG. 1)
Figure 3:
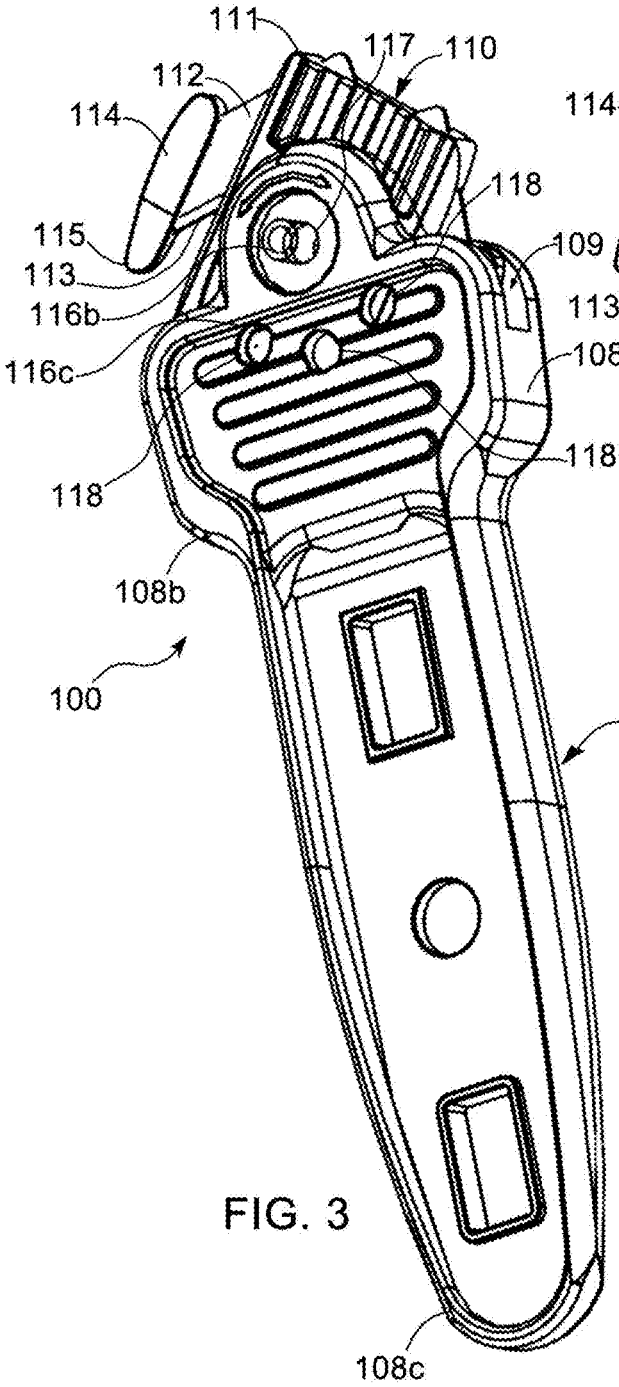
FIG. 3 is a perspective view thereof.

100, 101 safety utility knife
108*a* handle body
108*b* handle top
108*c* handle end
109 recess
110 blade carriage
111 blade mount
112 blade body
113 cutting edge
114 blade cap body
115 piercing portion
116*a* carriage shifter
116*b* carriage post
116*c* detent member
116*d* carriage hub
117 hub aperture
118 lock aperture
120 blade guard
121 blade guard pivot
122 auxiliary blade
123 auxiliary piercing member
124 tape splitter

DETAILED DESCRIPTION

The figures and following description illustrate and explain a utility knife 100, which may be used to cut rigid or semi-rigid materials, such as, for example, corrugated board, cardboard or other paper products, rubber, plastic, Styrofoam, or any other appropriate material. The utility knife 100 is typically a handheld device operated by either a left-handed or right-handed user with equal ease. In some implementations, the utility knife 100 allows the user to carry, transport, or otherwise handle the knife 100 in a safe position, whereby a sharpened blade edge 113 of the knife 100 is enclosed or substantially enclosed within a protective housing or handle, and, an end of the blade 112 is capped with a guide 114 that includes pointed/piercing portion 115 and blunted portions. The user may, as appropriate, engage the knife 100 into a material by engaging the guide/cap 114 attached to the blade into the material. As illustrated, the utility knife 100 includes a handle (or housing) that provides a gripping surface for a user of the utility knife 100. In some aspects, the handle may be manufactured to promote cleaning and sterilization of the utility knife 100, such as, for example, through the use of non-corrosive materials (e.g., stainless steel, aluminum, plastic, or other non-corrosive and/or inert material) and/or with open contours substantially free from undercuts (e.g., to eliminate or partially eliminate material being trapped in or on the utility knife 100). For example, in some aspects, the handle 108 (e.g., a solid, unibody structure) may be machine washable (e.g., through a dishwasher). In the detailed description that follows, the singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any implementation/embodiment disclosed herein may be combined with any object, feature or aspect of any other implementation/embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Handle end 108*c* may include an edge, a tape spitter 124 and/or a piercing portion 115.

Figure 4:
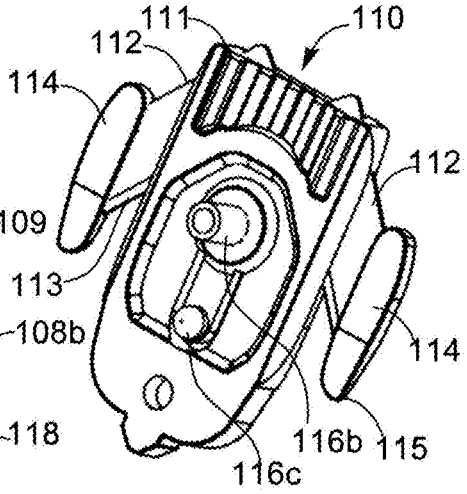
FIG. 4 is a perspective view of an example blade carriage.
Figure 5:
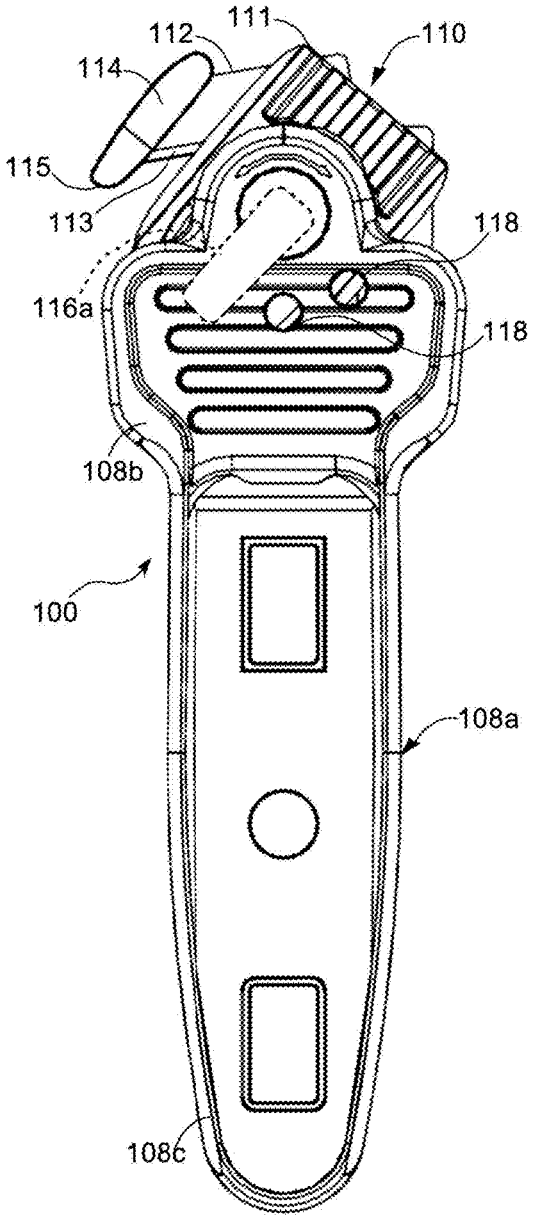
FIG. 5 is a side elevation showing the example blade carriage in a first active position.
Figure 6:
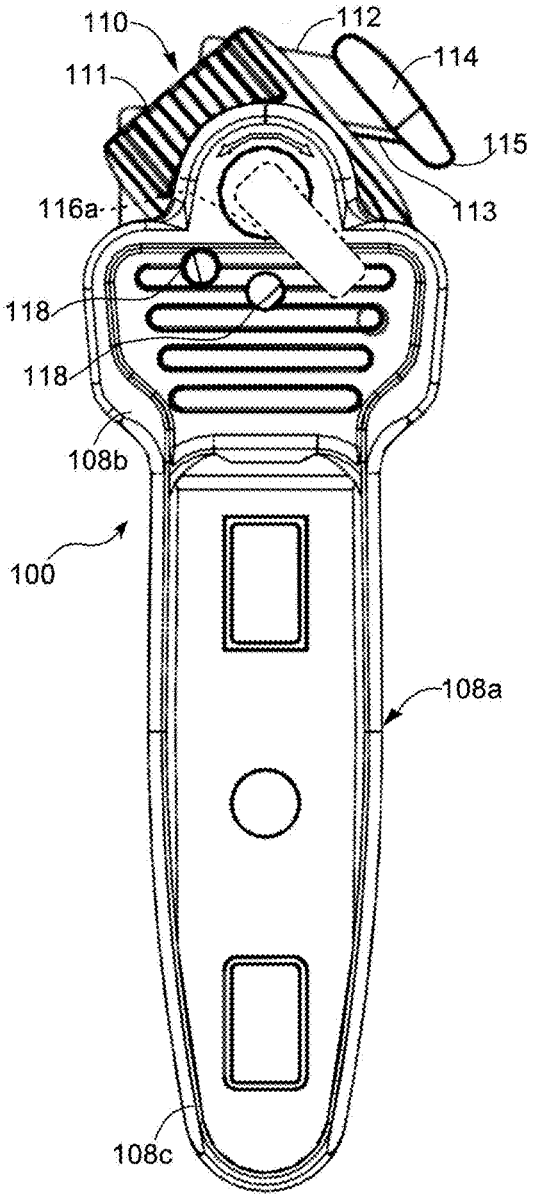
FIG. 6 is a side elevation showing the example blade carriage in a second active position.
Figure 7:
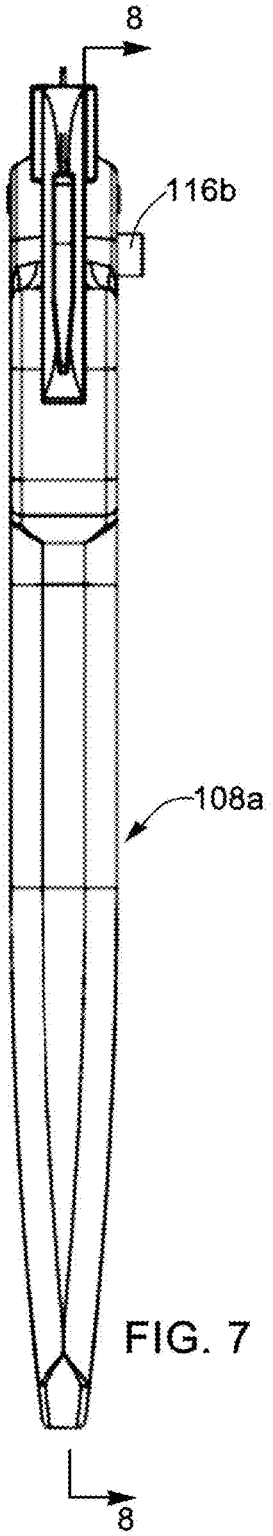
FIG. 7 is another side elevation.
Figure 8:
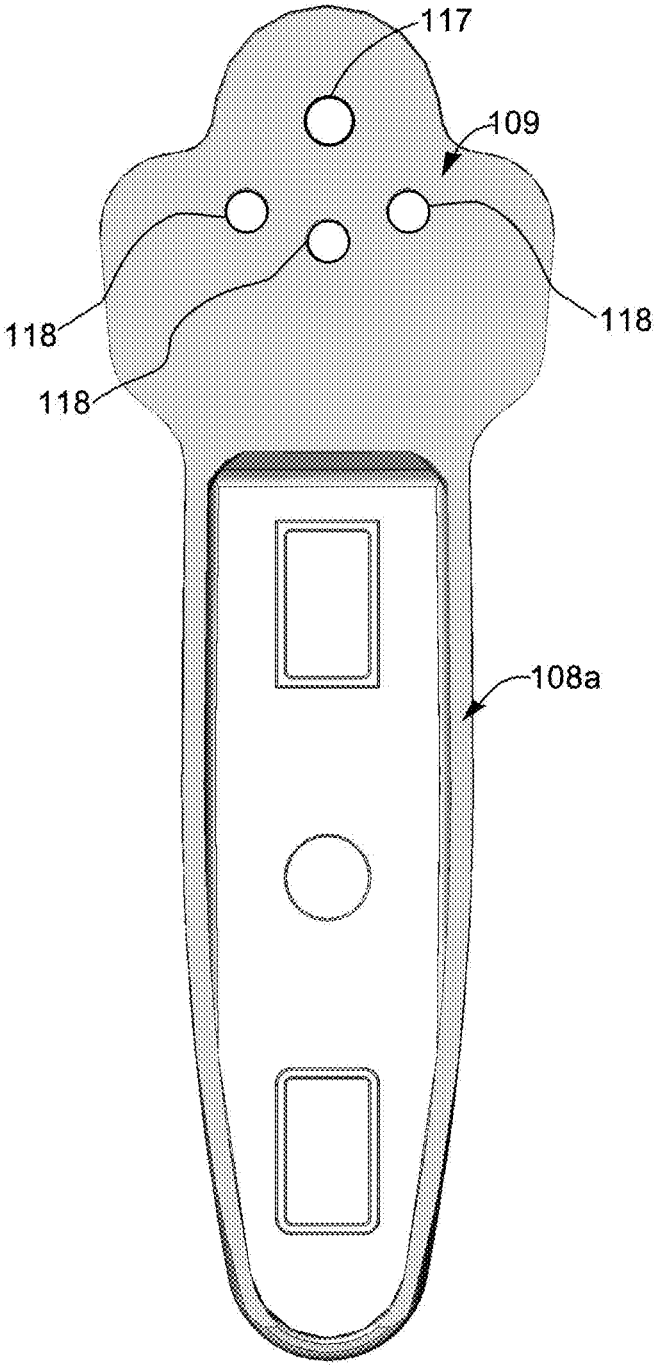
FIG. 8 is a cross-sectional view taken along lines 8-8 of (FIG. 7)
Figure 9:
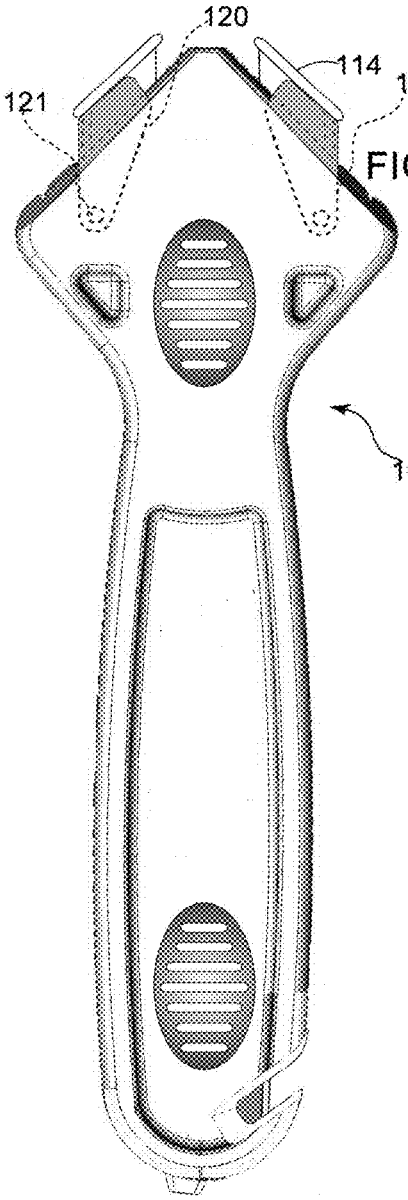
FIG. 9 is a side elevation of a second example implementation
Figure 10:
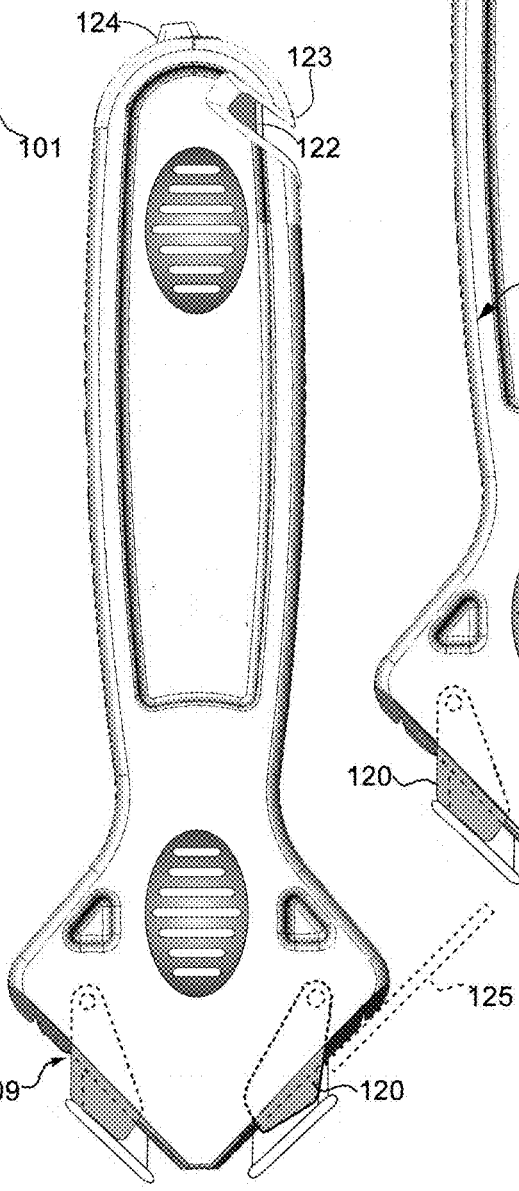
FIG. 10 is a side elevation thereof.
Figure 11:
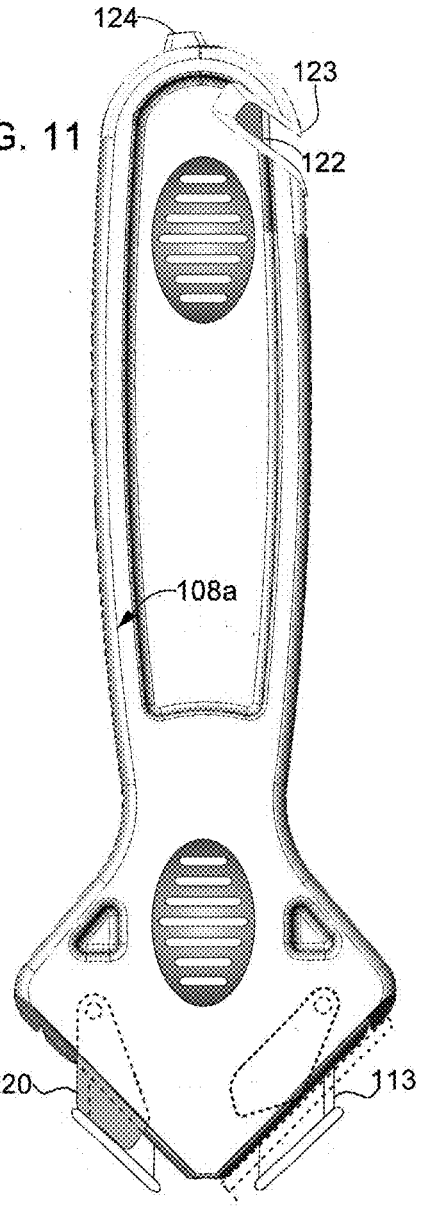
FIG. 11 is a side elevation thereof.

As depicted in FIGS. 1-8, a safety utility knife 100 includes a handle with a gripping surface. At one end of the handle 108*b* is a pivotable blade carriage 110 to which a pair of blades 112 are mounted. The pivotable carriage is configured to pivot between any one of three positions. In a neutral position the cutting edges 113 of both blades are shielded by portions of the handle. A first active position exposes a cutting edge of a first blade and a second active position exposes the cutting edge of a second blade. A guide/cap 114 is affixed to the distal end of each blade. A piercing portion 115 of the cap is pointed to facilitate piercing of a workpiece, e.g., corrugated paper. An underside of the cap—where the cap joins the blade, is blunted so that the cap can bear against the underside of a workpiece 125 and form a barrier between the cutting edge of the blade and package contents. The carriage may be shifted to any one of the foregoing positions by moving carriage shifter 116*a* which is connected to post 116*b* of the blade carriage 110. At least one detent member 116*c*, e.g., a ball bearing, a prong or other element which may engage portions of the handle, is mounted to the carriage (FIG. 4). In the particular implementation shown, a spherical member is spring loaded such that it maybe shifted from one lock aperture 118 to the next, thereby setting the blade position. Shifter 116*a* may be resilient and include a protrusion that is alignable with the lock apertures 118. The protrusion may be manually pressed into a lock aperture to displace one of the spring loaded spherical members from a nested (locked) position within one of the lock apertures, thereby freeing the carriage 110 to pivot.

Moving to FIGS. 9-13, another implementation of a safety utility knife 101 includes a handle with a gripping surface. A pair of blades 112 are mounted to an end of the handle. At either side of each blade is a pivotable guard 120. Each pivotable guard has a resting position wherein a leading blunted edge of the guard is even with or beyond the cutting edge 113 of the blade 112 in order to block accidental contact with the cutting edge. When a workpiece is moved against the handle as shown in (FIGS. 9 and 10), the workpiece makes contact with the pivotable guard and the guard is pivoted away from the cutting edge of the blade 112 thereby permitting the cutting edge to cut through the workpiece.

Figure 12:
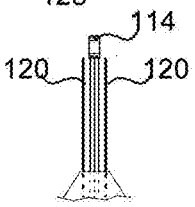
FIG. 12 is a detail view showing a blade adjacent guard pair.

FIG. 12 is a side elevation taken in the direction of the cutting edge that shows a blade with a guard at either side.

Figure 13:
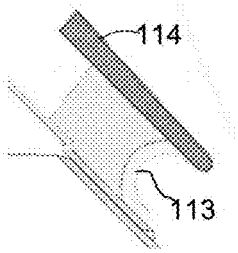
FIG. 13 is a plan view of example curved blade.

FIG. 13 shows another blade configuration with a curved cutting edge and an elongated cap/guide.

Figure 14:
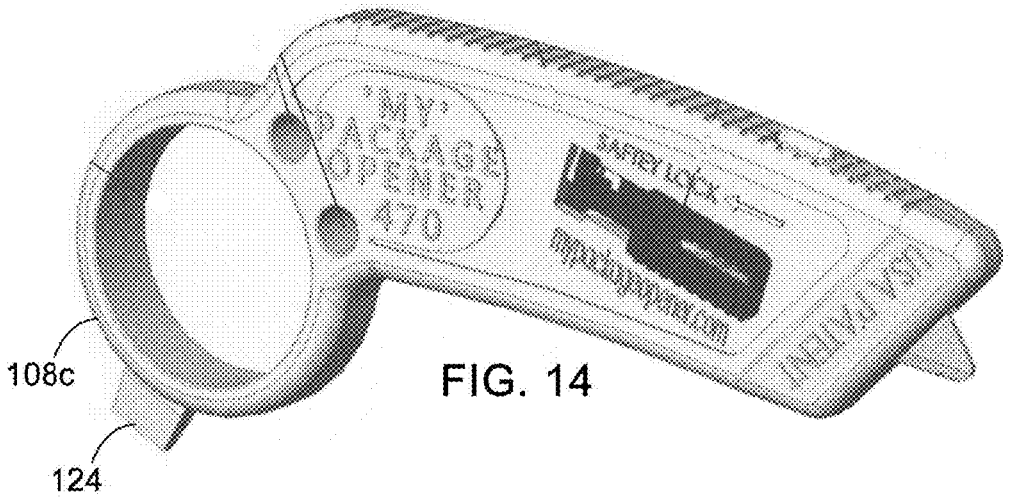
FIG. 14 is a perspective view of a third implementation of a safety blade.
Figure 15:
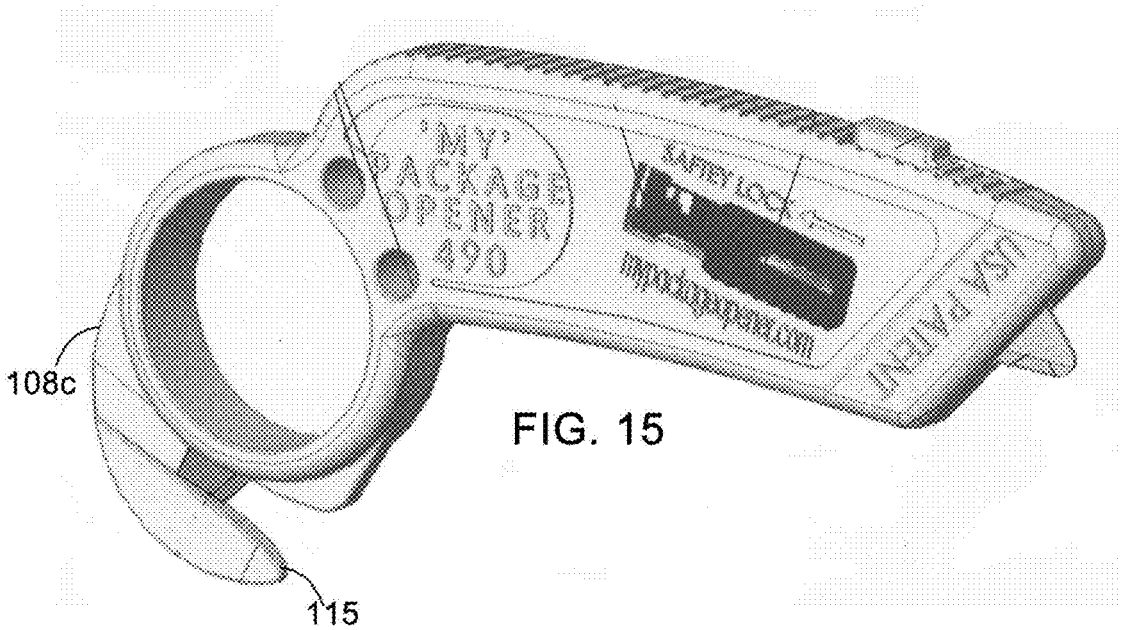
FIG. 15 is a perspective view of a fourth example implementation of a safety blade.

Moving to FIGS. 14 and 15, a third example implementation shows a handle with a gripping surface and a retractable blade. One end of the utility knife includes a finger ring hold with a tape splitter 124 or a piercing portion 115.

It should be understood that the drawings and detailed description herein are to be regarded in an illustrative rather than a restrictive manner, and are not intended to be limiting to the particular implementations, forms and examples disclosed. For example, while the particular examples given engageable members forming detents that are engaged and disengaged by a shifter, it is conceivable that more or less engageable members forming detents may be used in certain other implementations. Likewise, the blade with any shaped distal guard shown in any depicted implementation may be incorporated into other implementation shown. Accordingly, it is intended that this disclosure encompass any further modifications, changes, rearrangements, substitutions, alternatives, design choices, and implementations as would be appreciated by those of ordinary skill in the art having benefit of this disclosure, and falling within the spirit and scope of the following claims.

What is claimed is:

1. A safety utility knife, comprising:

a handle that comprises a gripping surface;

a pair of blades, each blade of the pair of blades includes a cutting edge and an end cap which is spaced from the handle;

a pair of pivotable guard member assemblies, each guard member assembly of the pair of guard member assemblies includes two pivotable guard members separated by a gap;

each guard member assembly includes a protective position wherein the cutting edge of a respective one of the pair of blades is disposed within the gap and the cutting edge is not readily accessible;

each guard member assembly includes an active position wherein the cutting edge of the respective one of the pair of blades is exposed;

the two pivotable guard members of each assembly are adjacent opposing sides of the cutting edge of the respective blade;

each guard member assembly includes a pivot point and is capable of pivoting independently respective of the other guard member assembly to expose the cutting edge of the respective blade disposed in the gap.

2. The safety utility knife according to claim 1 further comprising a tape splitter portion.

* * * * *